US005379952A

United States Patent [19]

Geiger

[11] Patent Number: 5,379,952

[45] Date of Patent: Jan. 10, 1995

[54] AGITATOR MILL

[75] Inventor: Armin Geiger, Bichwil, Switzerland

[73] Assignee: Bühler AG, Uzwil, Switzerland

[21] Appl. No.: 200,220

[22] Filed: Feb. 23, 1994

[30] Foreign Application Priority Data

Feb. 25, 1993 [CH] Switzerland ..... 00572/93

[51] Int. Cl.[6] ..... B02C 17/16

[52] U.S. Cl. ..... 241/65; 241/172; 241/300.1

[58] Field of Search ..... 241/46.11, 67, 172, 241/191, 300.1, 65

[56] References Cited

U.S. PATENT DOCUMENTS 3,788,565 1/1974 Adams ..... 241/46.11
4,059,232 11/1977 Engels ..... 241/46.17
4,174,074 11/1979 Geiger ..... 241/46.11
4,579,587 4/1986 Grant et al. ..... 75/0.5 R
4,651,935 3/1987 Samosky et al. ..... 241/65
4,761,263 8/1988 Politis et al. ..... 419/33
4,915,307 4/1990 Klimaschka et al. ..... 241/65

FOREIGN PATENT DOCUMENTS 0045498 2/1982 European Pat. Off. .
3918092 12/1989 Germany .
658802 12/1986 Switzerland .

*Primary Examiner*—John Husar
*Attorney, Agent, or Firm*—Martin A. Farber

[57] ABSTRACT

An agitator mill comprises a milling container and a rotor mounted therein. The rotor is built up in axial direction of individual rings and is provided with radially projecting agitator tools being integral with the rings and consisting of a wear-resisting material of good heat conduction. The rings are cooled by a cooling medium at their surfaces facing away from the grinding area.

14 Claims, 1 Drawing Sheet

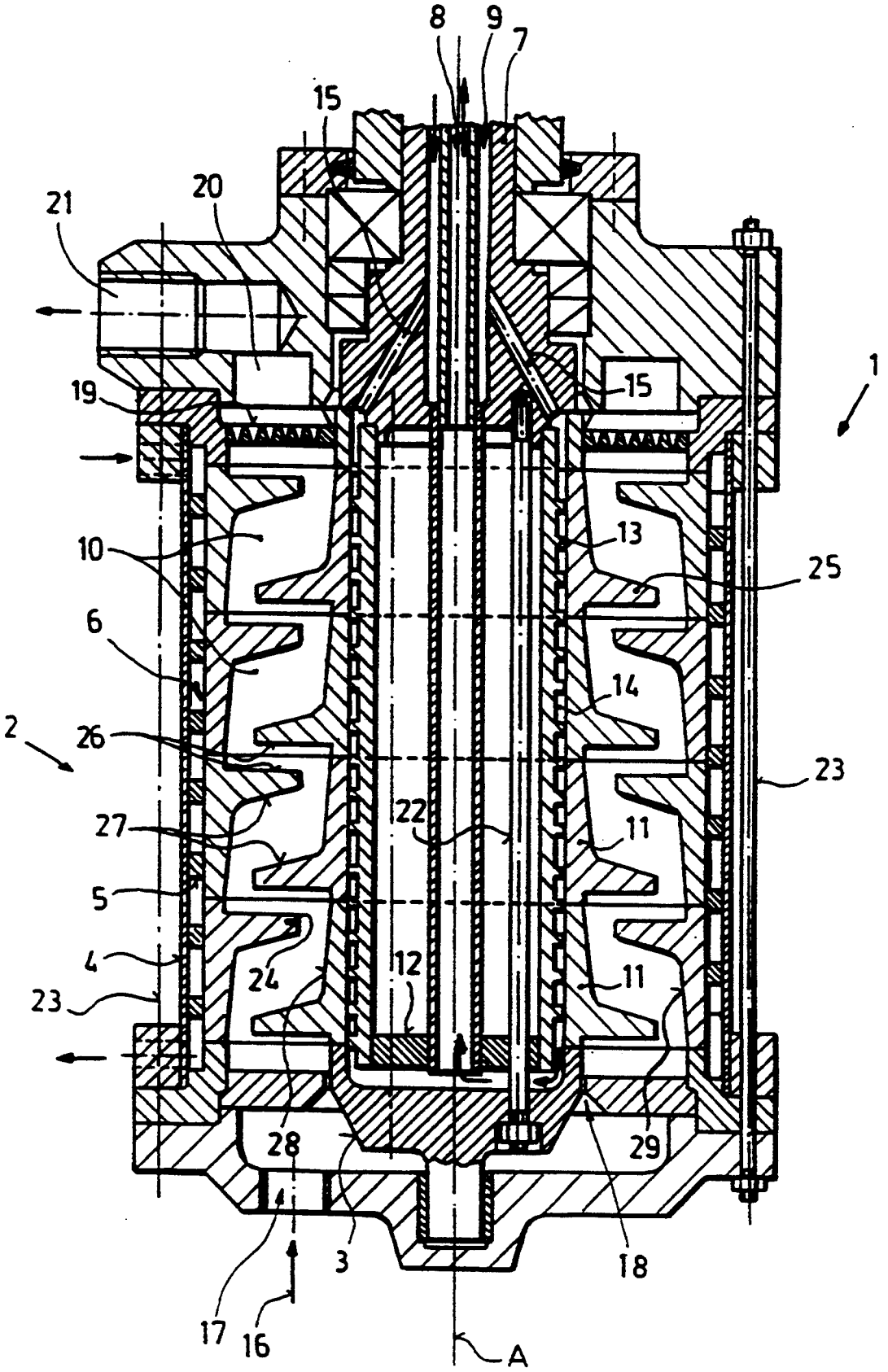
8
9
7
15
20
21
1
19
15
10
13
25
6
14
2
26
23
22
27
11
5
4
24
12
11
23
28
29
3
18
17
16
A

AGITATOR MILL

FIELD OF THE INVENTION

The invention refers to an agitator mill comprising a milling container and a rotor arranged within the milling container, of which at least one of them is made up of individual rings arranged in side-by-side relationship in axial direction, with at least part of the rings being provided with radially projecting members.

BACKGROUND OF THE INVENTION

Such a construction has become known from the U.S. Pat. No. 4,174,074, by way of example. From this reference it becomes apparent how the individual agitator tools are fastened to the rings of the rotor and of the milling containers. This is done by soldering in, cementing in place or by srewing the agitator tools into sink borings located on the wall of a ring or by combination of these connection methods.

In the case of such agitator mills these tools serve to impart to the grinding bodies contained in the milling container a positive or reflective motion within a suspension of material to be ground caused by the rotary movement of rotor and milling container relative to each other, which thereby keep on hitting against the agitator tools and cause their heating up.

The agitator tools are frequently bodies of a relatively low cross section, through which they convey the heat absorbed more rapidly into the material to be ground than it can be conveyed to the cooled ring of the milling container or of the rotor.

However, it is precisely this effect which is not desired, since a lot of materials to be ground are thermosensitive. For this reason, it has repeatedly been suggested to provide agitator tools with internal cooling (EP-A-0 045 498 and CH-A-658 802).

In the two documents mentioned above there can also be found detailed indications how the agitator tools with internal cooling can be fastened to the rotor or stator pieces of an agitator mill by soldering in or cementing in.

This has already been the case with uncooled agitator tools made up of full material as already described above, or else disk-shaped agitator tools have often merely been clamped to the rotor or stator pieces or held fast by interlocking connections, indentations and projections in their respective positions.

By means of the internal cooling of the agitator tools, the heat generated thereon could be conveyed to the cooling medium in an effective way. However, the construction of the agitator tools with internal cooling has led to another serious problem. If, owing to the high strain, an agitator tool is knocked out of the wall of the milling container or the rotor into which it is built in, with the intermediary layer formed by an adhesive or a solder being removed, this will lead to two highly undesired effects, for, on the one hand, cooling water will ingress into the product to be ground and will render this unserviceable if this material to be ground is sensitive to water, such as chocolate, and, on the other hand, material to be ground may enter the cooling channels, which will call for expensive and long-lasting repairs.

It is an object of the invention to provide an agitator mill in such a manner that the disadvantages associated with tools having internal cooling can be avoided and that the inconvenience caused by the unfavorable heat transmission to the cooling medium in the case of tools made of full material can be eliminated.

Nonetheless, there will still remain the cooling problem, whose solution appears difficult because of the contradicting requirements in the manufacture and use of an agitator mill.

SUMMARY OF THE INVENTION

In the sense of the invention, it is suggested in a second step to manufacture agitator tools and rings of the agitator chamber and/or the rotor out of one piece and to use a heat-conducting material.

Owing to this measure, the intermediary layer consisting of an adhesive or a solder employed up to now can be dispensed with, through which the heat conduction from the agitator tool to the rotor or to the milling container, or to its cooled side, respectively, will be improved to such a decisive extent that the cooling of the agitator tools can be effected by the cooled rings, which makes any flow of a cooling medium through the agitator tools themselves unnecessary.

By having the cooling medium flow on the rings with the agitator tools of the rotor and/or of the milling container, the heat generated in the agitator tools can be carried away from the agitator mill in an effective manner, with no danger existing of a mutual contamination of the fluids employed, since the rings—contrary to the tools—can be built much more stable.

The manufacture of ring and agitator tool out of one piece conveniently takes place under employment of a ceramic material, such as tungsten carbide, particularly of a silicon material, such as silicon carbide. Thus, the advantages of good heat conduction are combined with the great hardness and solidity of the material at those places that are subjected to increased wear by the grinding activity.

The invention not only solves the task in question but, in addition to that, there will even be surprisingly achieved a considerable simplification and cheapening of the manufacture, since the tools will no longer have to be fitted into and fastened to the rings separately, and additionally there will not be any difficult sealing problems.

It is particularly advantageous to manufacture the rings along with the agitator tools as provided by the invention by sintering, in particular by isostatic pressing and preferably by hot isostatic pressing.

An agitator geometry which is especially favorable in this context, but also independently of the design according to the claims is provided by designing the cooperating agitator tools of the milling container and the rotor with shearing surfaces appertaining to each other and running substantially parallel to one another, which extend in radial direction to the axis (A) and whose paths of revolution, under rotation of the rotor, partly overlap each other in radial direction at a small distance relative to the length of the agitator tools and particularly by designing the agitator tools of the milling container and/or the rotor with sloped surfaces on those sides facing away from the shearing surfaces, due to which sloped surfaces the agitator tools are provided at their transitions into the rings with substantially greater thicknesses than they have at their end sections, and by arranging the agitator tools at a front surface of the rings and such that the agitator tools of succeeding rings face each other with their shearing surfaces in the case of built-in rings.

BRIEF DESCRIPTION OF THE DRAWING

Further details of the invention will result from the following description of a cross section represented in the only figure of the drawing through an agitator mill as provided by the invention.

DETAILED DESCRIPTION OF THE DRAWING

An agitator mill 1 comprises a milling container 2, wherein a rotor 3 is rotatably mounted. The milling container 2 has an outer cooling jacket 4, e.g. of sheet metal, with welded on cooling ribs 5 running about helically over the circumference of the sheet metal, which cooling ribs 5 define helical cooling channels 6 running in axial direction relative to each other.

Analogous to that, the rotor 3 is mounted on a shaft 7 having an inner channel 8 and an outer ring channel 9, via which channels 8, 9 cooling is effected by supplying and carrying off a cooling medium, particularly cooling water.

The milling container 2 and the rotor 3 consist of individual rings 10, 11 formed of a hard material. While the rings 10 are arranged with their outer surfaces adjacent to the cooling ribs 5, the rings 11 are supported by a guide tube 12, which on its outer side—similarly to the milling container 2—is provided with cooling ribs 13 running helically over the circumference for forming cooling channels 14. These cooling channels 14 are connected to the outer ring area 9 of the shaft 7 via sloped channels 15. The cooling ribs 5, 13 can be designed as identical or different units in principle, and may also be designed in a different way, as they are represented here. For example, they can simply be formed of a helical ribbon or a string, e.g. of metal, particularly of an elastic material, such as rubber, yet with the rings 10, 11 being made of ceramic material it is preferred—contrary to their design according to the above-mentioned US-A—not to attach the cooling ribs to the rings, but to the respective piece 4 or 13 facing the rings 10, 11 or to design them as separate, helically arranged parts.

The product to be ground is supplied via an inlet 17 and an inlet separating gap 18 in the direction of an arrow 16 for retaining the grinding media provided in the interior of the milling container and then reaches via a corresponding outlet separating unit, such as the sieve 19, an outlet ring area 20, and from there it passes to an outlet 21.

The rings 10, 11 made of a hard material may consist of a ceramic material. If this is the case, there may result different heat extensions between the jacket 4 and the rings 10, on the one hand, and between the guide tube 12 and the rings 11, on the other hand. To compensate for any stresses thereby caused, the constructions of rotor and stator can be modified in such a manner as it is described, by way of example, in the DE-A-39 18 092 on the basis of the FIGS. 9 and 16 to 19, with the entire contents of this reference being incorporated herein by reference, in order to avoid a detailed description of the known construction. If this arrangement is chosen, it will be advantageous to clamp the individual rings 10, 11 by means of tensions bolts 22, 23, which in the form herein represented may run along the outer side of the milling container, but may also be screwed into an inner jacket wall (if made of metal), if required.

Unlike the prior art constructions, agitator tools 24 of the milling container 2 and agitator tools 25 of the rotor 3 are integrally formed with the rings 10, 11. In principle, the shape of these tools 24, 25 is of no importance, i.e. they may be shaped alike or differently on the milling container 2 and on the rotor 3, e.g. in the form of pins and disks or the like. In the embodiment represented they are preferably shaped as pins, although disks would also be conceivable.

By having the agitator tools 24, 25 integrally formed with the respective rings 10, 11, there can be avoided a barrier to be transgressed by the heat to be eliminated by heat conduction so that the heat elimination from the agitator tools 24, 25 is effected directly into the cooling channels 6 or 14. Owing to this, there will be achieved a heat transmission of low resistance, which will ensure an effective cooling particularly in a case where the units consisting of rings 10, 11 and tools 24, 25 are made of a ceramic material, such as silicon carbide in particular, or else of tungsten carbide.

In the case of the embodiment represented, four rings each are provided for building up the milling container 2 or the rotor 3, respectively, yet this number does not necessarily have to be the same with the rotor and the milling container. It would as well be conceivable to build up merely the milling container 2 or only the rotor 3 of such rings.

Furthermore, it would be conceivable to build up a mill only of one single ring in each case, although it is preferred to provide at least two such rings 10, 11. A greater number than four rings is possible, too.

In the embodiment represented, the tools 24, 25 have shearing surfaces 26 facing each other and running substantially parallel to one another. These shearing surfaces 26 at least approximately extend in radial direction relative to a center axis A of the rotor 3 and of the milling container 2, which also represents the rotational axis of the rotor 3. On the other hand, the tools 24, 25 have a surface 27 sloped in a radial direction on that side which faces away from the respective shearing surface 26. It is preferred to make the distance between the shearing surfaces 26 smaller than the one formed by the surfaces 27, which face away from the shearing surfaces 26, of the respective adjacent agitator tools of the milling container 2 and the rotor 3.

For reasons of strength it is advantageous to design the respective circumferential surface 28 or 29 of the rings 10, 11 slightly conical in such a manner that the thickness of the ring increases toward the respective agitator tool 24, 25, which, in either case, is a set of tools equally distributed over the circumference. This is particularly advantageous in a case where the tools 24, 25 are arranged approximately in the axial center of the respective rings 10 or 11 instead of being located in the area of a front surface of a ring 10 or 11, by way of example, with each respective ring being designed conical in such a manner that it has a thickness that conveniently increases toward the tool 24 or 25 from the two front surfaces. This will not only improve the strength at the transition or neck of the tools 24 or 25 projecting away from the ring, but it will also lead to a larger cross-sectional area for the heat transmission.

In such an arrangement, the design may be such that the milling container 2 and/or the rotor 3 have a very slight conical form of 0.5° to 5°, so that in the case of the milling container the top ring 10 has a slightly lower outer diameter than the bottom ring 10, which will facilitate the pushing of the rings into the outer jacket 4. In the case of the rotor 3, the top ring 11 can also have a slightly larger diameter than the bottom ring 11, with the guide tube 12 also being designed conical. In such a manner, it will be easier to slip the rings on or to pull them off.

In is to be understood that the above-mentioned geometrical designs of the tools and the rings or of the milling container and the rotor will, on the whole, not be affected by integrally forming the tools 24, 25 with the rings 10, 11 in single pieces or not, although in such a single-piece arrangement the shade formed by the surfaces 26, 27 has turned out to be particularly advantageous.

Neither is the invention limited to the previously mentioned slight conical form of the milling container 2 and/or the rotor 3, for it is also possible—especially in view of a simplified stock keeping—to design all the rings 10, 11 alike in each case.

It is to be understood that it will no longer be necessary to fasten the agitator tools 24, 25 separately to the rings 10, 11, so that their assembly—in addition to the desired improvement of the heat transmission—will be simplified and cheapened to an extraordinary extent. At the same time, their manufacture will be simplified as well, with the sintering of the rings 10, 11 having turned out as particularly convenient. To obtain uniform sealings, an isostatic pressing, and particularly a hot isostatic pressing, will be preferred.

Owing to the fact that the cooling channels 6, 14 are no longer extended into the tools 24, 25, the problem of the sealing of the agitator tools can now be regarded as settled, and along with it, also the danger of an unwanted mixing of the material to be ground being present in the form of a suspension with the cooling medium.

What is claimed is:

1. An agitator mill for continuous grinding and dispersing of material suspended in a liquid comprising a ring shaped grinding chamber defined by front sides of inner and outer corresponding wall means, wherein said outer wall means is a stator and said inner wall means is a rotor with a central rotor axis and at least one of said corresponding wall means is at least partially built up by ring means lined up along said rotor axis, wherein at least some of said ring means comprise agitator members projecting radially into said grinding chamber, said ring means have a rear side opposite to said front side, said agitator members are located at said inner and at said outer wall means in groups of corresponding agitator members, said agitator members including shear surfaces oriented radially to said rotor axis wherein said shear surfaces of corresponding agitator members are essentially parallel and leave under rotation a gap in the direction of said rotor axis smaller than the length of said agitator members, and said agitator members have a greater axial thickness at said wall means than at the free end of said agitator means.

2. Agitator mill as claimed in claim 1, wherein said ring means are made by a ceramic material.

3. Agitator mill as claimed in claim 2, wherein said ceramic material is tungsten carbide.

4. Agitator mill as claimed in claim 2, wherein said ceramic material is a silicon material.

5. Agitator mill as claimed in claim 4, wherein said silicon material is silicon carbide.

6. Agitator mill as claimed in claim 2, wherein said ring means are sintered.

7. Agitator mill as claimed in claim 2, wherein said ring means are fabricated by isostatic pressing.

8. Agitator mill as claimed in claim 2, wherein said ring means are fabricated by hot isostatic pressing.

9. Agitator mill as claimed in claim 1, further comprising helical cooling channels adjacent to said rear side of said ring means of at least one of said wall means, said channels being built by ribs extending from said rear sides and a cooling jacket contacting said ribs opposite to said rear side.

10. Agitator mill as claimed in claim 9, wherein said cooling jacket has a conical shape and the diameters of said ring means of said outer wall means are corresponding to said conical jacket.

11. Agitator mill as claimed in claim 9, wherein said cooling jacket is inside said rotor and has a conical shape and the diameters of said ring means of said inner wall means are corresponding to said conical jacket.

12. Agitator mill as claimed in claim 1, wherein said ring means have ring front sides facing said grinding chamber and conically extending towards said corresponding wall means, wherein said extending is increasing towards said agitator members.

13. Agitator mill as claimed in claim 1, wherein said agitator members are located in the vicinity of axial ends of said ring means, wherein said corresponding agitator members are located at opposite axial ends and have facing shear surfaces.

14. Agitator mill as claimed in claim 1, further comprising at least one tension bolt for holding together said ring means of at least one of said wall means.

* * * * *